US010154742B2

(12) United States Patent
Kazoglou

(10) Patent No.: US 10,154,742 B2
(45) Date of Patent: Dec. 18, 2018

(54) BED COVERING SYSTEM

(71) Applicant: Ignatios Kazoglou, Fort Lauderdale, FL (US)

(72) Inventor: Ignatios Kazoglou, Fort Lauderdale, FL (US)

( * ) Notice: Subject to any disclaimer, the term of this patent is extended or adjusted under 35 U.S.C. 154(b) by 0 days.

(21) Appl. No.: 15/247,607

(22) Filed: Aug. 25, 2016

(65) Prior Publication Data

US 2017/0055735 A1 Mar. 2, 2017

Related U.S. Application Data

(60) Provisional application No. 62/209,835, filed on Aug. 25, 2015.

(51) Int. Cl.

| | |
|---|---|
| ***A47G 9/04*** | (2006.01) |
| ***A47G 9/10*** | (2006.01) |
| ***A47G 9/02*** | (2006.01) |
| ***A47C 21/02*** | (2006.01) |

(52) U.S. Cl.

CPC ..... *A47G 9/04* (2013.01); *A47C 21/022* (2013.01); *A47G 9/0207* (2013.01); *A47G 9/10* (2013.01)

(58) Field of Classification Search

CPC ..... A47G 9/02; A47G 9/04; A47G 9/0207; A47C 21/00; A47C 21/026; A47C 21/022

See application file for complete search history.

(56) References Cited

U.S. PATENT DOCUMENTS

| | | | | |
|---|---|---|---|---|
| 2,623,221 A * | 12/1952 | Hickman | A47G 9/02 5/485 |
| 4,924,543 A * | 5/1990 | Hose | A47G 9/02 5/421 |
| 6,807,696 B2 * | 10/2004 | Magistretti | A47C 7/402 297/284.5 |
| 7,086,105 B1 * | 8/2006 | Gottlieb | A47C 21/026 5/492 |

* cited by examiner

*Primary Examiner* — Eric J Kurilla

(74) *Attorney, Agent, or Firm* — Allen F. Bennett; Bennett Intellectual Property

(57) ABSTRACT

An adjustable bed covering system includes a comforter having one or more connection strips for removably affixing pillows that may remain attached to the bed covering during the bed making process. The pillows have connecting strips compatible with the connecting strips found on the comforter. One or more pillows and/or the comforter may further include a flap for concealing or hiding the connecting strips. The bed covering may include a rigid rod or pole traversing the width of the comforter along its head end. The comforter may also be attached to mattress pockets that fit over the corners of a mattress in order to better align the comforter.

3 Claims, 5 Drawing Sheets

BED COVERING SYSTEM

CROSS-REFERENCE TO RELATED APPLICATIONS

This application claims priority to U.S. Provisional Application Ser. No. 62/209,835 filed on Aug. 25, 2015 the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to systems and methods for conveniently and an aesthetically covering a bed system. More particularly, the invention relates to an apparatus and method for rapidly covering and straightening a bed and arranging a comforter and pillows in a time efficient manner.

Description of the Related Art

During sleep, most people substantially disheveled the sheets, blankets, pillows and other objects commonly found on a standard bed. Generally, when a bed is not in use, people prefer a bed to be "made" such that the bedding is covered by a comforter or similar device and the pillows are arranged to create a neat, clean appearance. While the neat appearance of a made bed is often considered desirable, properly making a bed can be inconvenient and time-consuming. This may be especially true when only one person is making the bed. This often requires a single individual to shuttle back and forth from each side of the bed adjusting it many times before the bed attains the desired appearance.

A hotel or motel often must neatly arrange or otherwise make the beds of several different guests in many different rooms. This may consume a substantial amount of time for the hotel staff. Similarly, many children and even some adults dread the daily chore of making a bed.

It has also become more common for persons to desire multiple arrangements and styles for making up a single bed. This generally requires having a number of completely different bed covering systems.

A nimiety of devices and methods have been developed to change, alter or simplify the bed making process. Unfortunately, many of these alternative bed making devices and techniques serve only to further complicate the process. This is due in part to a desire to provide multiple arrangements of the same components in order to increase and enhance diversity of bed making arrangements as opposed to providing several different bedding materials for a single bed.

In view of the foregoing, there is a need to provide a simpler, more efficient method of effectively making a bed in a short amount of time and producing a superior results.

BRIEF SUMMARY OF THE INVENTION

Accordingly, the primary object of the present invention is to provide an adjustable but unitary bed covering system capable of multiple configurations while simultaneously simplifying the bed making process. In addition, the bed covering system of the present invention simplifies the making of a bed by a single person.

In greater detail, an adjustable unitary bed covering system in accordance with the principles of the invention may include a comforter or similar bed cover having one or more connection strips for removably affixing pillows that may remain attached to the bed covering during the bed making process. As a result, the need to separately arrange the pillows during bed making is decreased or eliminated.

In one embodiment, pillow include a connecting strip compatible with the connecting strips found on the comforter. One or both of the pillows and the comforter may further include a flap for concealing or hiding the connecting strips.

In another embodiment the pillow covers and/or the comforters are reversible. A comforter may include a plurality of connecting strips that may be hidden by a flap and may provide for arranging a plurality of pillows in a variety of configurations.

In a further embodiment, the bed covering may include a rigid rod or pole traversing the width of a comforter along its head end.

It is therefore an object of the present invention to provide an adjustable unitary bed covering system that reduces the amount of time required to make a bed without compromising the aesthetic appearance of the covering.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
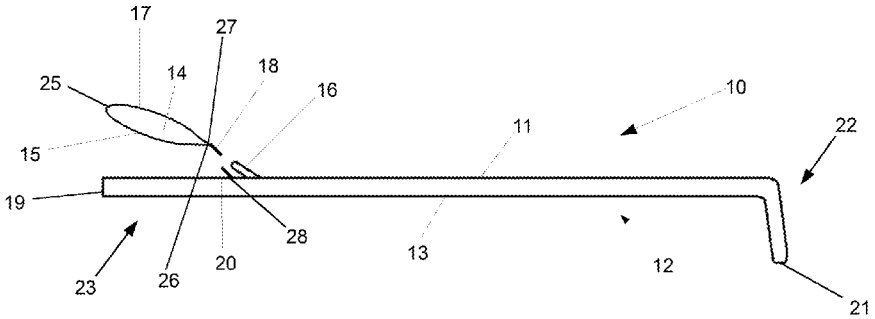
FIG. 1 is a side cross-sectional view of a bed covering system in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

Throughout this description, the terms "head" and "foot" are used in their ordinary customary meaning in relation to a bed. The term "medial" is generally used to refer to toward the center of an object. For example, as explained below, "pocket connecting strips" are referred to as the medial to the "foot region" of the comforter. In other words, the pocket connecting strips are near the foot region but located on the comforter apart from the foot region in the direction toward the head of the comforter. The term "headward" is used to indicate that one object is closer to the head compared to another. Similarly "footward" is used to indicate that an object is closer to the foot relative to another object. I.e., these are relational direction terms.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Disclosed is an adjustable unitary bed covering system in accordance with the principles of the invention that may be rearranged into multiple configurations. The adjustable unitary bed covering system of the invention, once configured in a chosen arrangement, may be easily and quickly used to cover, or make, a bed.

Figure 2:
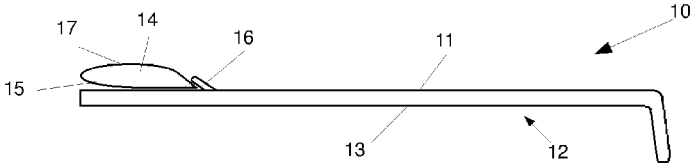
FIG. 2 is a side cross-sectional view of the bed coverings system in accordance with the principles of the invention.

FIGS. 1 and 2 show a bed covering system 10 having a comforter 12 and a pillow 14. The comforter 12 of this embodiment has a top side 11 and an underside 13 each extending from a head end 19 to a foot end 21. The foot region 22 of the comforter 12 is located at the foot end 21 of the comforter and is configured to hang down over the foot end of a mattress covered by the comforter 12. A head region 23 is located at the head end 19 and encompasses the region of the comforter 12 upon which a pillow 14 is usually placed. Optionally, the head region 23 may be lengthened to include a portion intended to hang down over the head end of a mattress in a manner similar to that of the foot region 22.

The top side 11 of the comforter 12 includes a pillow connecting strip 20 that is concealed by a flap 16. In this embodiment, the connecting strip 20 is not connected to the flap 16. It is attached to the top side 11 of the comforter 12, slightly headward relative to the flap 16 at one end 28, and hangs freely from the comforter 12. The flap 16 is sewn, or otherwise affixed, to the top 11 of the comforter 12 in such a way that the flap is biased to fold in a headward direction and lay over the pillow connecting strip 20. Optionally, the underside 13 may include additional pillow connecting strips and corresponding flaps for concealing them. By providing pillow connecting strips to the underside 13, the comforter becomes reversible so that the top side and the underside may be interchanged.

The pillow 14 also includes a top side 15 and an underside 17 extending between a first end 27 and a second end 25. Optionally, the pillow 14 may also be reversible such that the top side 15 and the underside 17 may be interchanged. The pillow 14 includes a comforter connecting strip 18 that removably engages the pillow connecting strip 20 of the comforter 12. In this embodiment, the connecting strip 18 is an elongate rectangular strip attached at its proximal side 26 to the first end 27 of the pillow 14 and hangs freely therefrom. FIG. 1 shows the comforter 12 and the pillow 14 detached. When the pillow 14 is detached from the comforter 12, the flap 16 covers connecting strip 20. FIG. 2 shows the pillow 14 attached to the comforter 12 with the flap 16 covering the attached connecting strips 18 and 20.

When the pillow 14 is secured to the comforter 12 by use of connecting strips 18 and 20, the comforter 12 and pillow 14 may both be placed over a mattress simultaneously and are automatically arranged relative to each other in a configuration dictated by the location of the connecting strip 20. Alternatively, the comforter 12 may be positioned over a bed and the pillows may be attached by engaging the connecting strips 18 and 20 after the comforter is positioned correctly on the bed. Both of these methods simplify the process of properly arranging a comforter and pillows. The pillow 14 and the comforter 12 are always arranged in the exact same manner every time a bed is made. This reduces the time required to make the bed and ensures uniformity. As a result, this embodiment may be desirable for use in a hotel or hotel chain that desires uniformity. It may also be desirable for hotels desiring to improve efficiency of its room cleaning staff. A comforter may optionally include a plurality of connecting strips that provide a plurality of alternative configurations for pillows attached thereto.

The connecting strips may be complementary strips of a zipper, hook-and-loop mechanism, tongue and groove, snaps, buttons, laces or the like. Zippers and other metallic or mechanical devices may be considered non-aesthetically pleasing. The flap 16 may cover the connecting strips 18 and 22 and improve appearance of the bed covering system and disguise the connected nature of the comforter 12 and pillow 14. Thus, the comforter and pillow combination may give the appearance of more carefully arranged separate individual components.

FIG. 2 shows the comforter 12 and the pillow 14 connected and in place, arranged as they would be on top of a bed. The flap 16 conceals the connecting strips 18 and 20, providing a smooth appearance.

Figure 3:
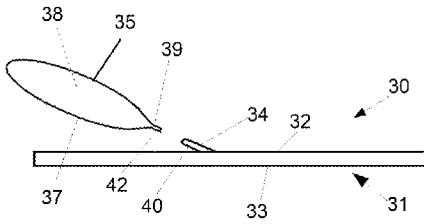
FIG. 3 is a side cross-sectional view of an alternative embodiment of a bed covering system in accordance with the principles of the invention.

FIG. 3 shows an alternative embodiment of an adjustable bed covering system 30. The bed covering system 30 includes a comforter 31, again having a top side 32 and an underside 33 which may have different colors and/or patterns. The comforter 31 may include a pillow connecting strip 34. In this embodiment, the connecting strip 40 is located on the underside of the flap 34. The pillow 38 has a top side 35 and an underside 37, each having a separate color and/or pattern. The pillow 38 also includes a comforter connecting strip 42 that hangs freely from a first end 39 of the pillow 38. The comforter connecting strip 40 is complementary to the connecting strips 34 of the comforter 31. When connecting strips 34 and 40 are connected, the flaps 42 on the pillow conceals the connection. This embodiment creates the appearance that the region where the connecting strips are located, covered by the flaps 42, is merely a portion of the pillow 38. As with the embodiment shown in FIGS. 1 and 2, this embodiment allows two separate components, a pillow and a comforter, to be consistently arranged in the same manner.

Figure 4:
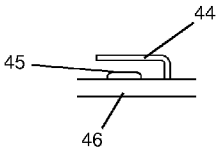
FIG. 4 is a side cross-sectional view of a pillow connecting strap and a flap on a comforter in accordance with the principles of the invention.
Figure 5:
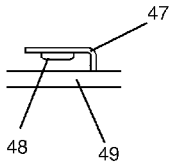
FIG. 5 is a side cross-sectional view of an alternative pillow connecting strap and a flap on a comforter in accordance with the principles of the invention.

FIG. 4 shows a pillow connecting strip 45 on a comforter 46 covered by a flap 44 in more detail. In FIG. 4, the pillow connecting strip 45 is affixed directly to the comforter. The flap 44 is separately attached to the comforter and configured to lay over the connecting strip to conceal it. FIG. 5 shows an alternative embodiment of a pillow connecting strip 48 that is attached directly to one side of a flap 47 which is then connected to the comforter. Both of the configurations shown in FIGS. 4 and 5 are suitable for use of the present invention.

Figure 6:
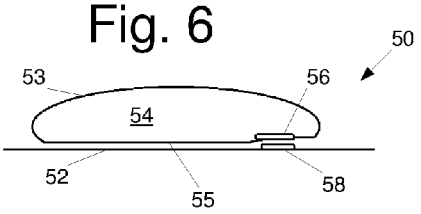
FIG. 6 is a side cross-sectional view of an alternative embodiment of a bed covering system in accordance with the principles of the invention.
Figure 7:
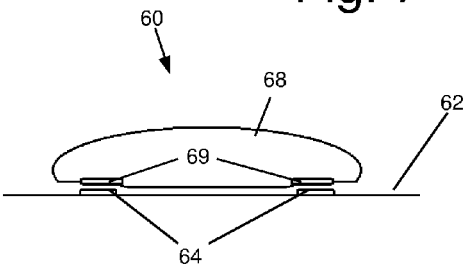
FIG. 7 is a side cross-sectional view of an alternative embodiment of a bed covering system in accordance with the principles of the invention.

FIG. 6 shows an alternative embodiment of a bed covering system 50 including a comforter 52 and a pillow 54. In this embodiment, the comforter 52 includes a pillow connecting strip 58 that may lie flat along the surface of the comforter, instead of hanging freely from one end. The pillow 54 includes a top side 53 and an underside 55. A comforter connecting strip 56 complementary to the pillow connecting strip 58 is positioned near the intersection of top side 53 and underside 55. This embodiment does not include a concealing flap or similar device on either the pillow or comforter. FIG. 7 shows another alternative embodiment 60 of a comforter 62 having to pillow connecting strips 64, both of which lay flat on the comforter 62 and do not hang freely. In this embodiment, the pillow connecting strips 64 and complimentary comforter connecting strips 69 are arranged substantially parallel to each other and substantially transverse on the top of the comforter 62. I.e., the strips are parallel to the head end and the foot end. Other configurations are possible.

Figure 8:
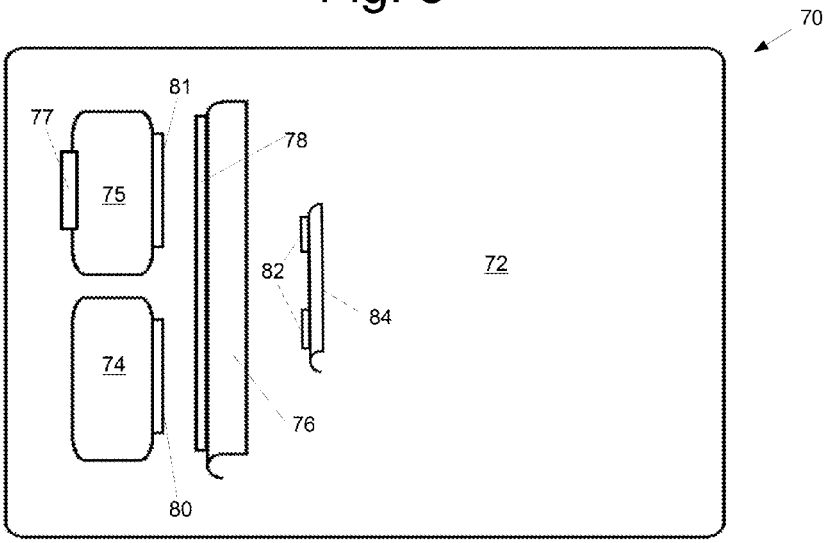
FIG. 8 is a top plan view of an alternative embodiment of a bed covering system.

FIG. 8 shows an alternative embodiment of a bed covering system 70 similar to the embodiment shown in FIGS. 1 and 2. A comforter 72 includes a pillow connecting strip 78 and a concealing flap 76 footward to the pillow connecting strip and affixed to the comforter 72 in such a manner that it is biased to lay down in a headward direction, thereby covering the pillow connecting strip 78 when it is not attached to a pillow. The pillow 74 includes a comforter connecting strip 80. The pillow 75 includes a comforter connecting strip 81 substantially similar to comforter connecting strip 80 and complementary to pillow connecting strip 78. The pillow 75 also includes a second connecting strip 77 positioned opposite to connecting strip 81. This may allow the pillow 75 to have another pillow or other object attached to it in sequence, and may allow alternatively allow the pillow 75 to be reversed.

In this embodiment, the comforter 72 has a single continuous connecting strip 78. One, two or three pillows 74 may be connected to this single strip 78 by their own complementary connecting strips 80. Optionally other pillows having other configurations may be arranged in a variety of sequences along the connecting strip 78.

Comforter 72 also includes additional connecting strips 82 and a concealing flap 84. Additional pillows may be connected to one or both of concealing strips 82 for arrangements in front of pillows 74 or other objects connected to connecting strip 78. Those skilled in the art will appreciate that many different objects may have a connecting strip added to it so that it may be affixed to a connecting strip on a comforter. For example, a stuffed animal toy or a designer pillow may be modified to be added to a comforter in accordance with the principles of the invention.

Connecting strips 78 and 80 of comforter 72 are arranged parallel to one another. A comforter optionally includes additional connecting strips that may or may not include corresponding concealing flaps positioned perpendicular to, or at obtuse or acute angles to, other connecting strips. By altering the number, shapes and arrangements of connecting strips, the number of configurations possible using the comforter and pillows or other objects may be expanded.

Figure 9:
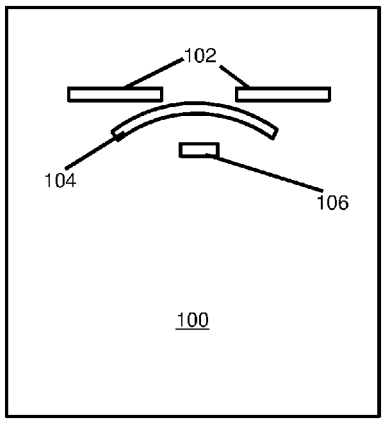
FIG. 9 is a top plan view of an alternative embodiment of a bed covering system without pillows attached in accordance with the principles of the invention.
Figure 10:
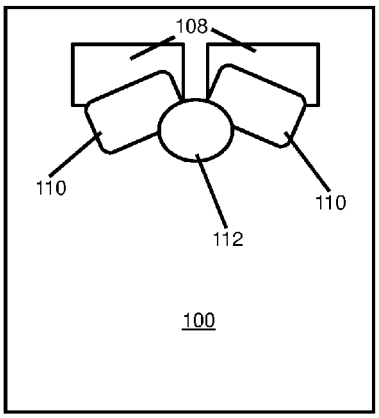
FIG. 10 is a top plan view of an alternative embodiment of a bed covering system with pillows attached in accordance with the principles of the invention.

FIGS. 9 and 10 show an alternative embodiment of a comforter 100 with and without pillows removably secured to it. The comforter 100 include two connecting strips 102 arranged in a bilaterally symmetric fashion, a curved connecting strip 104 and another connecting strip 106 in front of connecting strips 102 and 104. FIG. 10 shows pillows 108 attached to connecting strips 102, two pillows 110 each attached to different sides of curved connecting strip 104 and a round pillow 112 attached to connecting strip 106.

The pillows 108, 110 and 112 may be re-arranged in a variety of configurations on the connecting strips 102, 104 and 106. The pillows 108, 110 and 112 may have different colors and/or patterns on different sides, further increasing the variety of arrangements possible. Further, the comforter 100 may include connecting strips in different configurations on its opposite side to further increase the variety of arrangements possible. Once the pillows have been arranged in a desired pattern on the comforter 100, they will remain in that pattern after the comforter has been fully or partially removed from the bed and will also retain their arrangement when the comforter 100 is placed over a bed again when the bed is being made. This may substantially decrease the amount of time required to arrange and properly make a bed.

Figure 11:
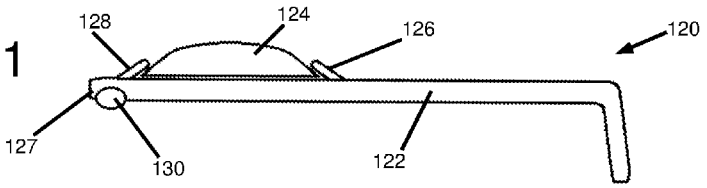
FIG. 11 is a side cross-sectional view of an alternative embodiment of a bed covering system in accordance with the principles of the invention.
Figure 12:
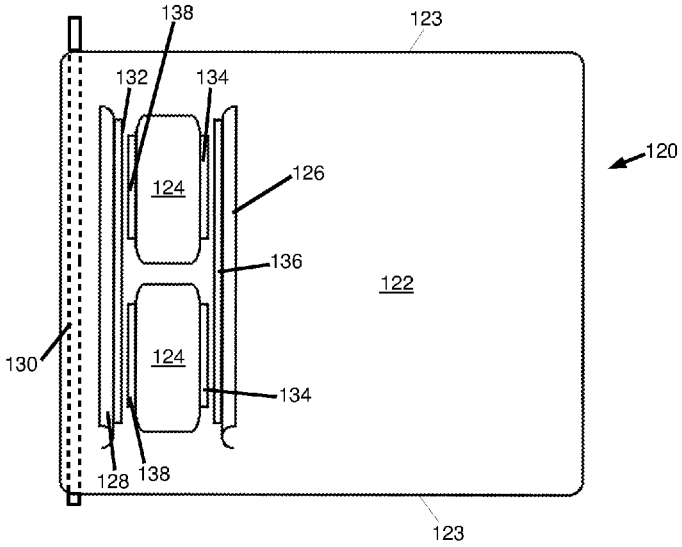
FIG. 12 is a top plan view of an alternative embodiment of an adjustable unitary bed covering system in accordance with the principles of the invention.

FIGS. 11 and 12 show additional alternative embodiments of an adjustable unitary bed covering system 120. FIG. 10 shows a comforter 122 having a medial flap 126 and a distal flap 128 covering connecting strips on the comforter 122 and the attached pillow 124. The connecting strips themselves are not shown in FIG. 11. Optionally, concealing flaps are located on the pillow rather than the comforter. The comforter 122 also includes a rigid or semi rigid rod 130 that traverses the width of the comforter 122 near the distal head end 127 of the comforter 122. The rod 130 may be grasped firmly on one side of a bed and used to pull the comforter 122 and any attached pillows over a bed, thus eliminating the need for a single person to commute back and forth between the two sides of the bed in order to arrange the comforter and pillows symmetrically.

FIG. 12 shows the comforter 122 from above, showing rod 130 completely traversing the width of the comforter 122 and protruding beyond the sides 123 of the comforter 122. FIG. 12 also shows flaps 126 and 128 peeled back, exposing the comforter connecting strips 136 and 132, respectively. Two pillows 124 may include opposing connecting strips 134 and 138, which may be complementary to connecting strips 136 and 132, respectively.

Figure 13:
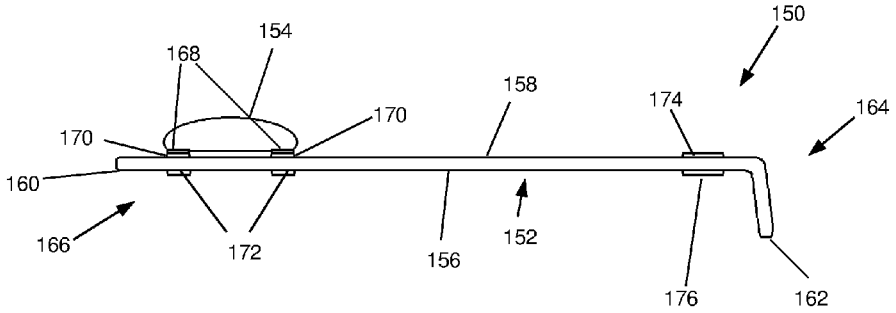
FIG. 13 is a side cross-sectional view of an alternative embodiment of a bed covering system in accordance with the principles of the invention.
Figure 14:
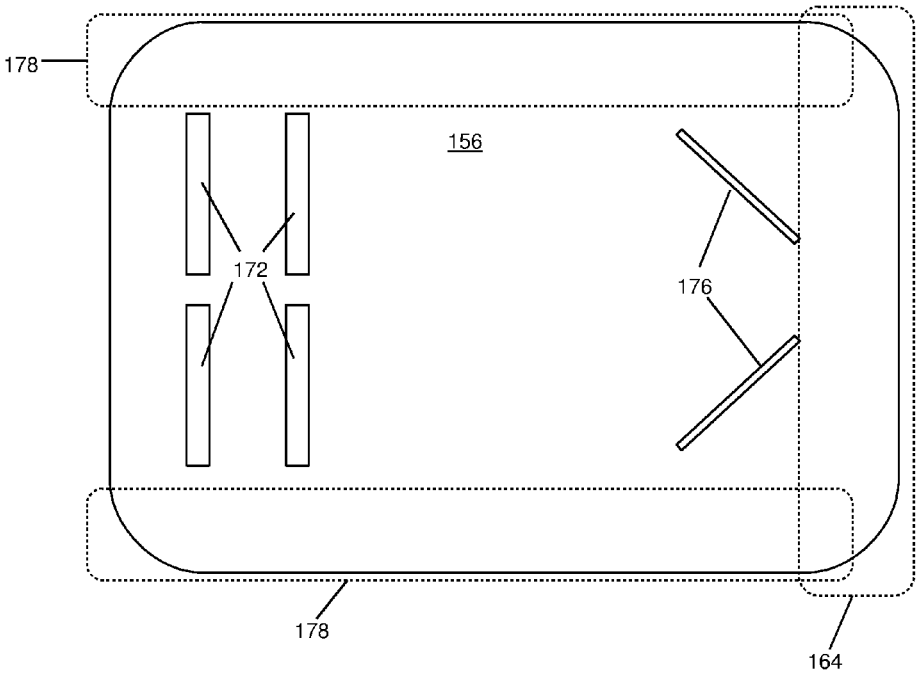
FIG. 14 is a bottom plan view of an alternative embodiment of a bed covering system in accordance with the principles of the invention.

FIGS. 13 and 14 show another alternative embodiment of a bed covering system in accordance with the principles of the invention. Bed covering system 150 includes a comforter 152 and a pillow 154. The comforter 152 has a top side 158 and an underside 156 and extends from a head end 162 a foot in 162. A foot region 164 is configured to hang over the foot of a bed. Side regions 178 are similarly configured to hang over sides of a bed. The top side 158 includes pillow connecting strips 170 that correspond to comforter connecting strips 168 on the pillow 154. In this embodiment, the underside 156 also includes pillow connecting strips 172.

The top side 158 and the bottom side 156 also include mattress pocket connecting strips 174 and 176, respectively. As may be seen in FIG. 13, the mattress pocket connecting strips 176 are at an approximately 45° angle relative to the sides, head end 160 and foot end 162. The mattress pocket connecting strips allow the comforter 152 to be connected to mattress pocket in order to more quickly, easily and accurately align a comforter over a mattress.

Figure 15:
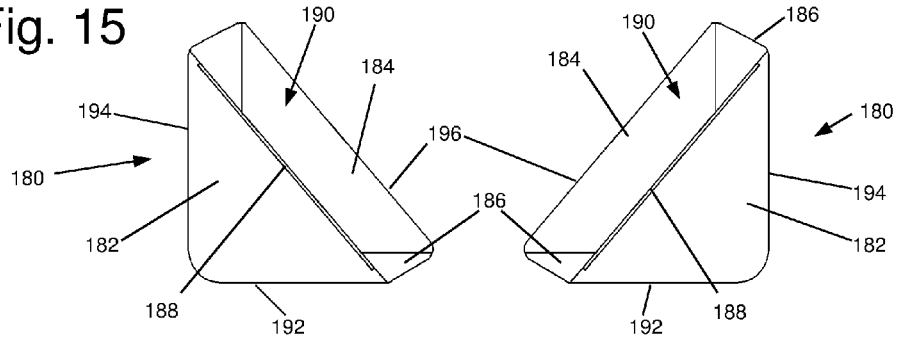
FIG. 15 is a perspective view of two mattress pockets in accordance with the principles of the invention.
Figure 16:
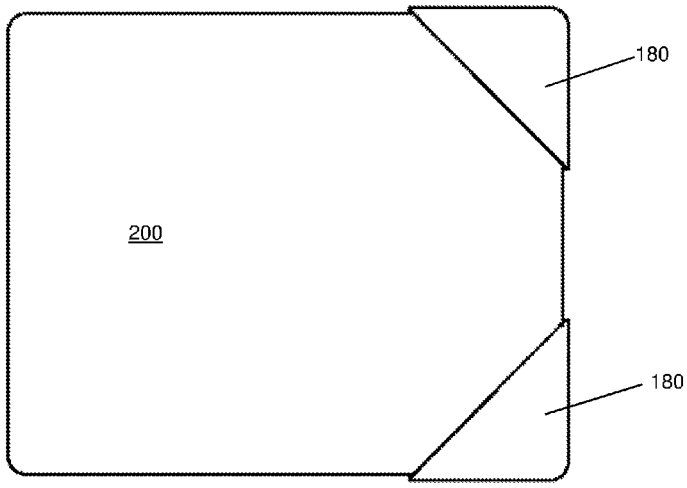
FIG. 16 is a top plan view of a mattress to which to mattress pockets are attached in accordance with the principles of the invention.

FIG. 15 shows two mattress pockets 180 in accordance with the principles of the invention. Each mattress pocket 180 has a top triangular gusset panel 182 and a symmetric corresponding underside triangular gusset panel 184. An L-shaped panel 186 extends between the two triangular gusset panels 182 and 184 and runs along the two shorter of the three sides of the triangular gusset panels 182 and 184. As a result, these three panels form a triangular pocket 190 open between the two longest sides 196 of the triangular gusset panels 182 and 184 and is configured to fit on the corners of a mattress. The triangular gusset panels 182 and 184, and/or the L-shaped panel 186 may be formed from a fabric commonly used in bedding materials or may optionally incorporate harder materials to improve rigidity or structure if desired. The longest side of the top triangular gusset panel 182 has a comforter connecting strip 188 running along it. The comforter connecting strip is complementary to the pocket connecting strips 174 and 176. FIG. 16 shows two mattress pockets 180 affixed to the corners of a mattress 200. Generally, the mattress pockets 180 will be affixed to the corners of a mattress 200 at the foot of a bed.

Figure 17:
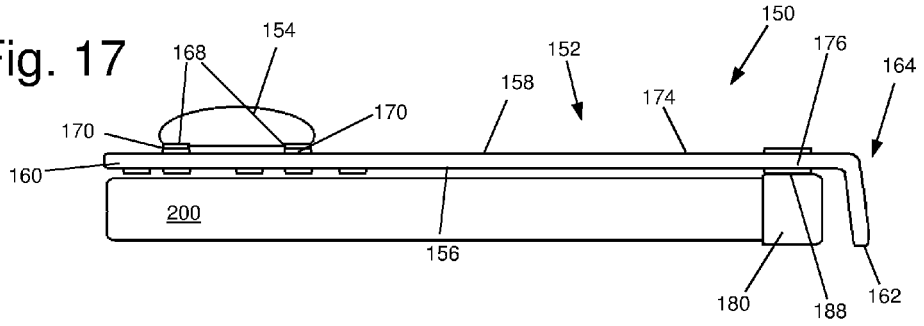
FIG. 17 is a side elevation view of a bed covering system affixed to a mattress in accordance with the principles of the invention.

FIG. 17 shows the bed covering system 150 of FIGS. 12 and 13 positioned over the mattress 200 of FIG. 16. The pocket connecting strips 176 have been attached to the comforter connecting strips 188 of the two pockets 180. Once the comforter has been affixed to the mattress pockets 180, it may simply be pulled in a head word direction, i.e. toward the head of the bed, and the comforter plus any attached pillows will automatically align in a desired configuration. In this manner, a bed may be made and remade many times and the comforter and pillows will always be positions in the same locations relative to each other. This simplifies the bed making process and allows many bed to consistently be made and arranged in precisely the same configuration.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A bed covering system comprising:

a comforter having a top side and an underside, and defined by a head end and a foot end, the top side having at least one pillow connecting strip;

at least one pillow having a top side and an underside and defined by a head end and a foot end, the underside having at least one comforter connecting strip removably attachable to the at least one pillow connecting strip;

two mattress pockets, each sized to fit over the corners of a mattress and comprising an upper triangular gusset panel, a lower triangular gusset panel connected by an L-shaped panel, each pocket having a comforter connecting strip on the upper triangular gusset panel;

wherein the underside of the comforter further comprises two pocket connecting strips complimentary to and removably attachable to the comforter connecting strips of the mattress pockets.

2. The bed covering system of claim 1 wherein the at least one pillow connecting strip comprises a plurality of pillow connecting strips on the top side of the comforter.

3. The bed covering system of claim 1 optionally including a rod traversing the width of the comforter at the head end for spreading the bed covering system over a bed by one person positioned on one side of the bed.

* * * * *